US008371459B1

(12) United States Patent
Rekhels

(10) Patent No.: US 8,371,459 B1
(45) **Date of Patent: *Feb. 12, 2013**

(54) ROTATABLE DISPLAY CAROUSEL AND ASSOCIATED METHOD

(76) Inventor: Alexander Rekhels, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/548,023

(22) Filed: Jul. 12, 2012

Related U.S. Application Data

(63) Continuation of application No. 12/949,634, filed on Nov. 18, 2010, now Pat. No. 8,272,519, which is a continuation-in-part of application No. 11/706,740, filed on Feb. 13, 2007, now abandoned.

(60) Provisional application No. 60/820,910, filed on Jul. 31, 2006.

(51) Int. Cl.
*A47F 5/02* (2006.01)
*A47B 11/00* (2006.01)

(52) U.S. Cl. ..... 211/163; 108/139

(58) Field of Classification Search ..... 211/1.51, 211/1.52, 78, 95, 163, 165; 108/20, 22, 94, 108/103, 104, 105, 139; 221/113, 119, 120, 221/281, 282; 40/429, 430, 493, 503, 505, 40/506; 472/29, 31; 312/125, 135, 305
See application file for complete search history.

(56) References Cited

U.S. PATENT DOCUMENTS 466,767 A * 1/1892 Brock et al. ..... 108/103
729,642 A * 6/1903 Nash ..... 108/94
1,208,457 A * 12/1916 Bellville ..... 108/94
1,213,026 A * 1/1917 Sande ..... 108/103
1,254,983 A * 1/1918 Chadwick ..... 108/22
1,604,304 A * 10/1926 Perkanis ..... 83/555
1,689,865 A * 10/1928 Davis et al. ..... 40/505
2,512,465 A * 6/1950 Moorhouse ..... 312/125
3,506,260 A * 4/1970 Johnson ..... 472/29
3,897,063 A * 7/1975 Lehwalder ..... 273/280
4,179,168 A * 12/1979 Isaac et al. ..... 312/125
4,269,124 A * 5/1981 Rosenthal et al. ..... 108/103
4,442,942 A * 4/1984 Cuminale et al. ..... 211/163
4,850,658 A * 7/1989 Sandor ..... 312/225
5,088,604 A * 2/1992 Baur et al. ..... 211/1.55
5,109,989 A * 5/1992 Kremmin et al. ..... 211/1.55
6,945,872 B2 * 9/2005 De Vogel ..... 472/63
7,665,244 B2 * 2/2010 Jesness, III ..... 47/39
2008/0282589 A1 * 11/2008 Joukov ..... 40/505

* cited by examiner

*Primary Examiner* — Darnell Jayne
*Assistant Examiner* — Joshua Rodden

(57) ABSTRACT

A rotatable display carousel may include a stationary central rod and a bottom plate rotatably mounted about the central rod. A plurality of shelf sections may be rotatably positioned above the bottom plate respectively. A rotating mechanism may be used to simultaneously rotate each shelf section respectively by rotating the bottom plate about the central rod. In this manner, each shelf section rotates in sync based upon a rotational speed of the bottom plate. The central rod remains stationary while the bottom plate and the shelf sections rotate respectively. The structural arrangement enables the plurality of shelf sections to be dynamically linked to the bottom plate in such a manner that the shelf sections synchronously rotate upon rotation of the bottom plate.

14 Claims, 4 Drawing Sheets

ROTATABLE DISPLAY CAROUSEL AND ASSOCIATED METHOD

CROSS REFERENCE TO RELATED APPLICATIONS

This application is a continuation of U.S. patent application Ser. No. 12/949,634, filed Nov. 18, 2010, which is a continuation-in-part application of U.S. patent application Ser. No. 11/706,740, filed Feb. 13, 2007, now abandoned, which claims the benefit of U.S. Provisional Application No. 60/820,910, filed Jul. 31, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to display cases and, more particularly, to a rotatable display carousel for providing a user a means of exhibiting a plurality of products within a confined area.

2. Prior Art

Retail outlets have employed a number of different techniques for displaying merchandise and promotional items to customers. Wall and floor cabinets are commonly used as permanent fixtures to display merchandise, and many of these have locking drawers or doors to prevent access to the items on display except by an employee with a key. In some instances, portable cases are used to display promotional items and products which are smaller in size such as watches, jewelry or the like. These portable cases typically rest on top of a base cabinet, or on a shelf.

One prior art example shows a display case that comprises a first section having a top wall, a bottom wall and a back wall connected between the top and bottom walls, and, a second section having opposed side walls with a front wall connected between them. The second section slides into engagement with the first section to form a closed interior. The bottom wall of the first section is integrally formed with a bracket which includes first and second arms connected in an inverse, L-shape, with one of the arms oriented parallel to and spaced from the bottom wall to form a space within which a shelf is received. A thumb screw or other mounting device extends through the bracket arm to engage the shelf and secure the display case thereto. Unfortunately, this prior art example does not provide a means of rotating the display such that merchandise is effectively displayed to a consumer.

Another prior art example shows an illuminated display apparatus comprising a frame member and a housing for containing a three-dimensional object. The illuminated display apparatus further includes a light source mounted within the housing for illuminating the object contained within the housing of the apparatus. Unfortunately, this prior art example also does not provide a means of rotating the display. In addition, this display is of a limited size, and is not suitable for housing a plurality of differently sized objects simultaneously.

Accordingly, a need remains for a rotatable display carousel in order to overcome the above-noted shortcomings. The present invention satisfies such a need by providing an assembly that is convenient and easy to use, is lightweight yet durable in design, and provides a user a means of exhibiting a plurality of products within a confined area. Such an assembly can be used to display products to promote sales, or to provide a variety of utilitarian functions other than retail commerce. The assembly allows a display to be attractive, as well as conservative in space requirements. The present invention is simple to use, inexpensive, portable, and designed for many years of repeated use.

BRIEF SUMMARY OF THE INVENTION

In view of the foregoing background, it is therefore an object of the present invention to provide an assembly for a rotatable display carousel. These and other objects, features, and advantages of the invention are provided by a rotatable display carousel for exhibiting a plurality of products within a confined area.

In particular, the rotatable display carousel may include a stationary central rod and a bottom plate rotatably mounted about the central rod. A plurality of shelf sections may be rotatably positioned above the bottom plate respectively. A simultaneous rotating mechanism may be used to rotate each of the shelf sections respectively by rotating the bottom plate about the central rod such that each of the shelf sections rotate in sync based upon a rotational speed of the bottom plate. Such an arrangement provides the unexpected and unpredictable advantage of enabling the central rod to remain stationary while the bottom plate and the shelf sections rotate respectively. The arrangement further enables the plurality of shelf sections to be dynamically linked to the bottom plate in such a manner that the shelf sections effortlessly rotate in sync relative to the rotation of the bottom plate.

Each of the shelf sections may be simultaneously rotated about a unique fulcrum axis centrally registered along a corresponding longitudinal length of the shelf sections respectively. The bottom plate may rotate about a central fulcrum axis defined along the central rod. Each of the shelf sections may further complete more than one revolution when the bottom plate completes one revolution. The central rod may be positioned orthogonal to the bottom plate and remains centrally aligned between the shelf sections such that the central rod is equidistantly spaced from the shelf sections respectively. Such an arrangement provides the unexpected and unpredictable advantage of balancing the opposing forces of the shelf sections with the bottom plate in such a manner that the apparatus continuously rotates in a stable manner without the risk of vibrating and falling apart.

The simultaneous rotating mechanism may include a primary pulley statically mated to the central rod and located subjacent to the bottom plate respectively. A plurality of auxiliary shafts may pass through the shelf sections respectively and may be rotatable relative to the bottom plate. A plurality of auxiliary pulleys may be statically mated to the auxiliary shafts and rotatable relative to the bottom plate. A flexible belt may be directly engaged with each of the primary and auxiliary pulleys respectively. Such an arrangement provides the unexpected and unpredictable advantage of connecting the shelf sections in tandem with each other to orbit around the primary pulley as well as rotate about their respective auxiliary shafts when the bottom plate is rotatably turned. One skilled in the art understands that the ability of the shelf sections to complete more than one revolution when the bottom plate completes one revolution is achieved by calibrating the diameters of the auxiliary pulleys to be smaller than the diameter of the primary pulley.

The rotation of the bottom plate causes the auxiliary pulleys to orbit as well as rotate. Such motions cause belt rotation about the auxiliary pulleys in such a manner that the auxiliary pulleys rotate along a first rotational path while simultaneously orbiting about the primary pulley. The primary pulley remains stationary while the bottom plate rotates along a second rotational path. Thus, the shelf sections rotate clockwise while the bottom plate also rotates clockwise respectively. Such an arrangement provides the unexpected and unpredictable advantage of providing uni-directional (either clockwise or counter clockwise rotation) of the shelf sections as well as the bottom plate.

Each of the shelf sections may include a plurality of planar divider members equidistantly spaced apart and radially extending outward from the auxiliary shafts respectively. A plurality of pie-shaped shelves may be directly abutted with adjacent ones of the divider members respectively such that each the pie-shaped shelf is isolated from an adjacent and co-planar one of the pie-shaped shelves such that the pie-shaped shelves may be capable of supporting objects placed thereon. Each of the auxiliary shafts may be statically mated to the divider members and the pie-shaped shelves so that the shelf sections rotate in sync with the auxiliary pulleys respectively. Such an arrangement provides the unexpected and unpredictable advantage of displaying a plurality of articles on the shelves within a confined area.

The carousel may further include a base member statically mated to a bottom end of the central rod and a top plate rotatably mated to the central rod. The top plate is attached to the bottom plate via anchor rods. In this way, the base member and the central rod may remain stationary while the top and bottom plates as well as the shelf sections rotate respectively. Such an arrangement provides the unexpected and unpredictable advantage of ensuring that the carousel is easily placed and supported by the base member on a variety of display or exhibition areas.

The invention may include a method of utilizing a rotatable display carousel for exhibiting a plurality of products within a confined area. Such a method may include the chronological steps of: providing a stationary central rod; providing and rotatably mounting a bottom plate about the central rod; providing and rotatably positioning a plurality of shelf sections above the bottom plate respectively; rotating each of the shelf sections respectively by rotating the bottom plate about the central rod such that each of the shelf sections rotate in sync based upon a rotational speed of the bottom plate; and maintaining the central rod stationary while the bottom plate and the shelf sections rotate respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
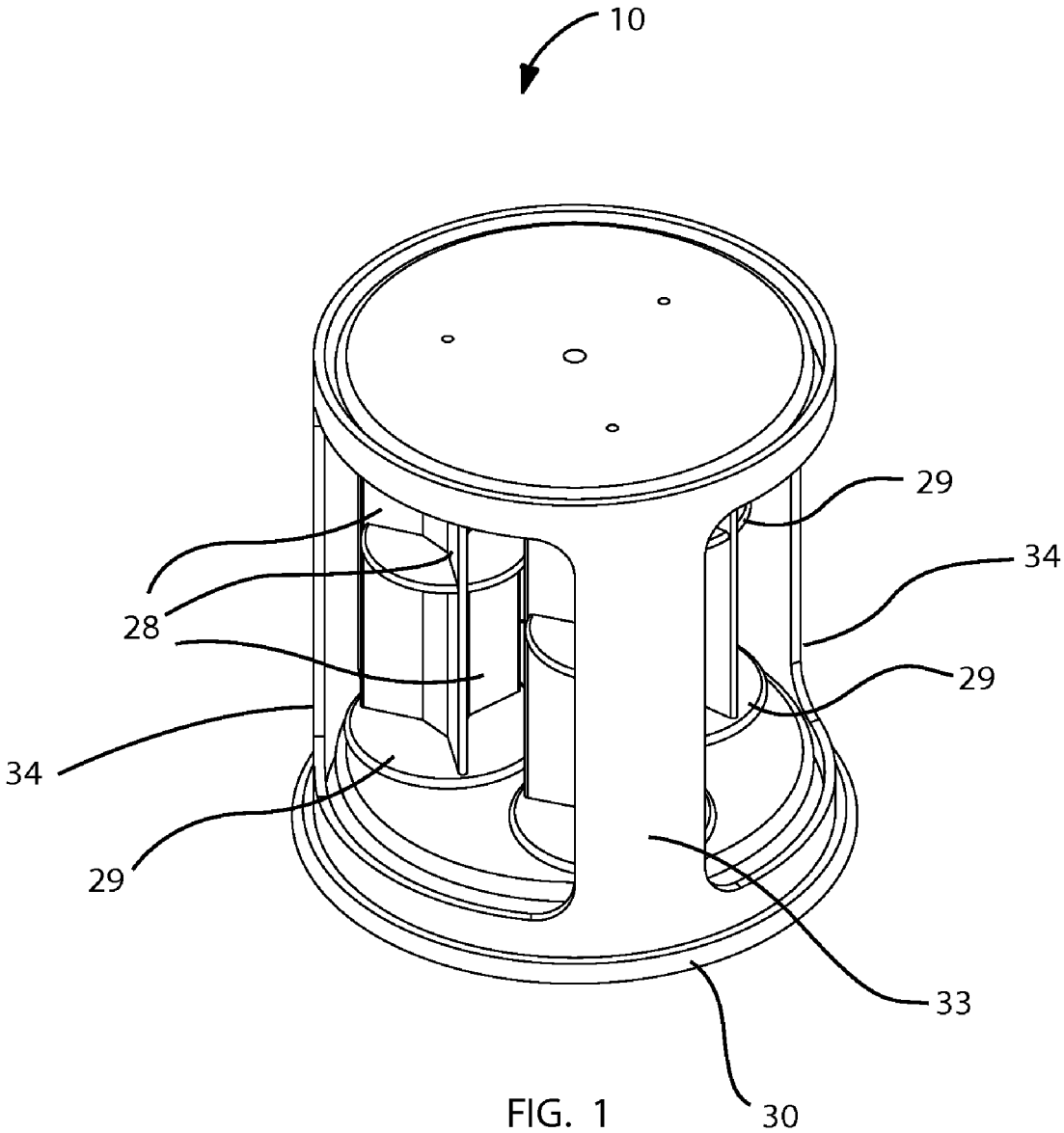
FIG. 1 is a perspective view of the rotatable display carousel, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The assembly of this invention is referred to generally in FIGS. 1-5 by the reference numeral 10 and is intended to provide a rotatable display carousel. It should be understood that the assembly 10 may be used to display many different types of objects and should not be limited in use to displaying only those objects described herein.

Referring generally to FIGS. 1-5, the rotatable display carousel 10 may include a stationary central rod 20 and a bottom plate 21 rotatably mounted about the central rod 20. Notably, the stationary rod 20 does not rotate (remains stationary) when the bottom plate 21 rotates. A plurality of shelf sections 22 may be rotatably positioned above the bottom plate 21 respectively. Each shelf section 22 has an auxiliary shaft 25 statically attached thereto and rotatable relative to said bottom plate 21 (shafts 25 rotate in same direction as central rod 20 but at a different revolution/minute). As a non-limiting example, each auxiliary shaft 25 may be vertically aligned and registered parallel to the central rod 20.

A simultaneous rotating mechanism 23 may be used to rotate each of the shelf sections 22 respectively by rotating the bottom plate 21 about the central rod 20 such that each of the shelf sections 22 rotate in sync (and in the same direction; i.e. clockwise) based upon a rotational speed of the bottom plate 21 (rotates in same direction as shelf sections 22; i.e. clockwise). Such an arrangement provides the unexpected and unpredictable advantage of maintaining the central rod 20 stationary while the bottom plate 21 and the shelf sections 22 rotate in the same direction, respectively. By maintaining the central rod 20 at a stationary position, the carousel 10 is maintained at a substantially stable position while external torque is applied to said bottom plate 21. This overcomes the risk of undesirably oscillating the shelf sections 22 and/or bottom plate 22 in uneven rotational directions during extended use. This structural arrangement further enables the plurality of shelf sections 22 to be dynamically linked to the bottom plate 21 in such a manner that each shelf section 22 rotates in sync to each other relative to a rotational speed of the bottom plate 21.

Figure 5:
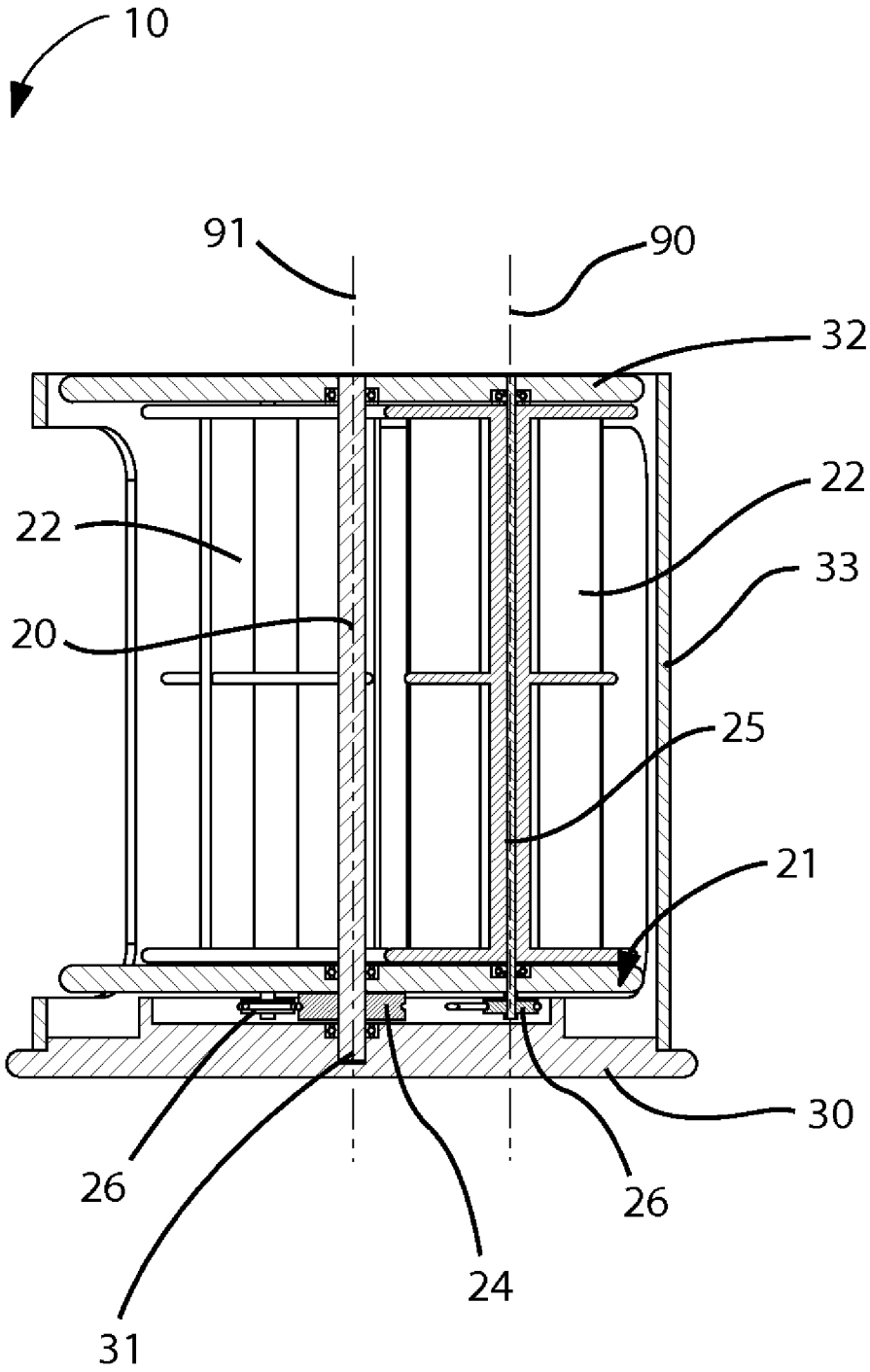
FIG. 5 is a cross-sectional view taken along line 5-5 in FIG. 3, showing the bottom plate rotatably attached to the stationary central rod as well as rotatably attached to the auxiliary shafts.

Referring to FIG. 5, each of the shelf sections 22 may be simultaneously rotated in a same direction about a unique fulcrum axis 90 centrally registered along a corresponding longitudinal length of the shelf sections 22 respectively. The bottom plate 21 may rotate in the same direction as the shelf sections 22 and about a central fulcrum axis 91 defined along the central rod 20. As noted above, each shelf section 22 may rotate relative to a rotation of the bottom plate 21. For example, each shelf section 22 may complete more than one revolution in a clockwise direction when the bottom plate 21 completes one revolution in a clockwise direction.

As a non-limiting example, the central rod 20 may be positioned orthogonal to the bottom plate 21 and remain centrally aligned between the shelf sections 22 such that central rod 20 is equidistantly spaced from the shelf sections 22 respectively. Such a structural arrangement provides the unexpected and unpredictable advantage of balancing opposing forces of the shelf sections 22 with the bottom plate 21 in such a manner that the carousel 10 continuously rotates in a substantially stable manner by limiting undesirable vibration and oscillation between the shelf sections 22 and bottom plate 21.

Figure 2:
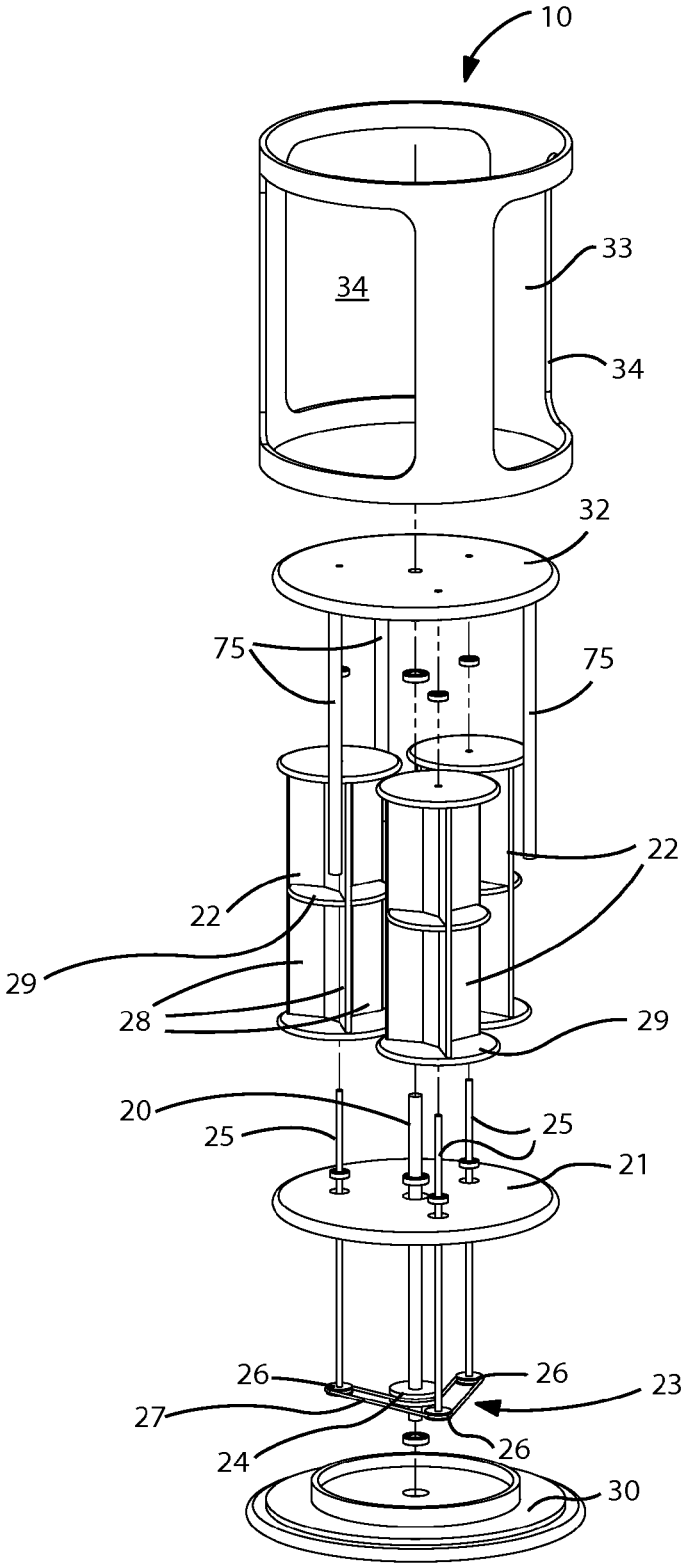
FIG. 2 is an exploded view of the carousel shown in FIG. 1.
Figure 3:
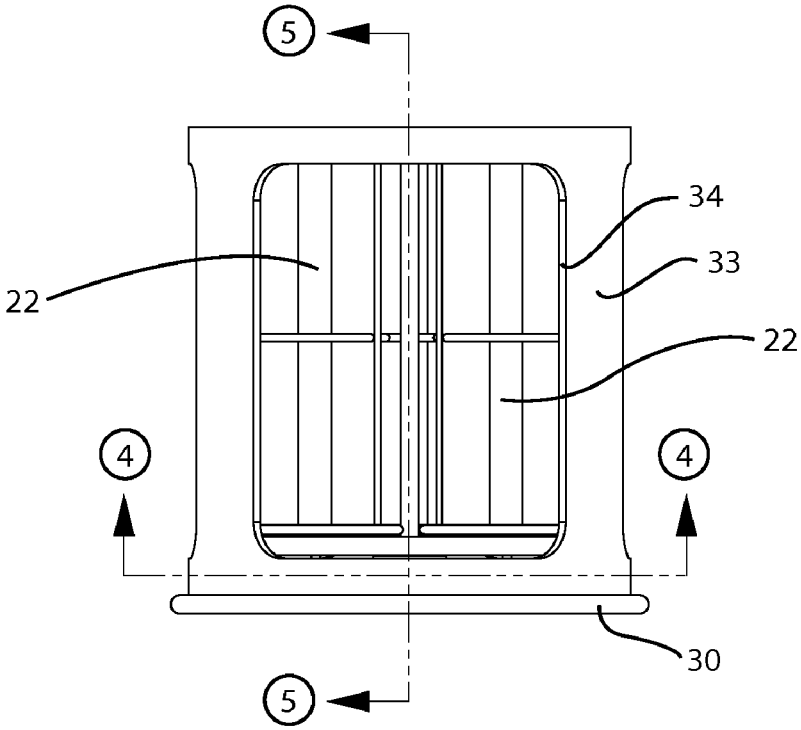
FIG. 3 is a side elevational view of carousel shown in FIG. 1.
Figure 4:
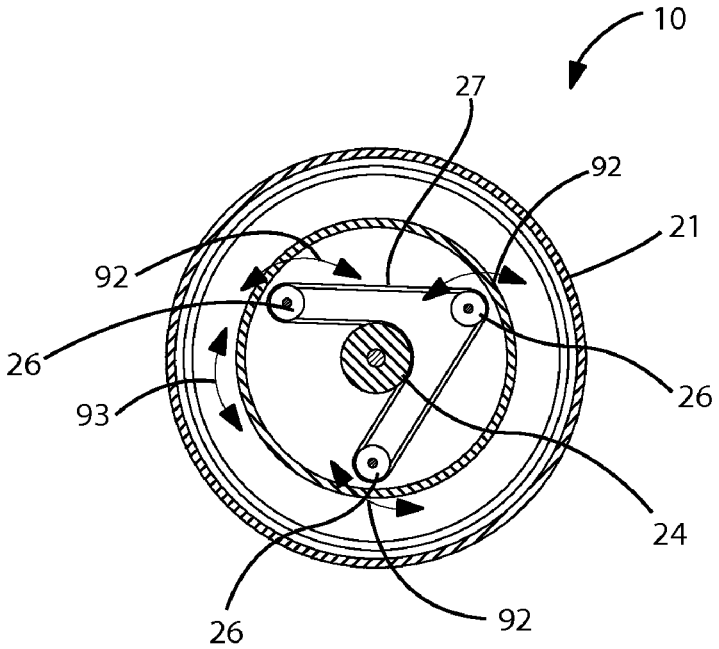
FIG. 4 is a cross-sectional view taken along line 4-4 in FIG. 3, showing the interrelationship between the stationary primary pulley and rotating auxiliary pulleys as well as the rotating belt.

Referring to FIGS. 2, 4 and 5, in a non-limiting example, the simultaneous rotating mechanism 23 may include a primary pulley 24 statically mated to central rod 20 and located subjacent to bottom plate 21. Primary pulley 24 may further be statically mated about the central rod 20 respectively. Notably, the primary pulley 24 remains stationary and does not rotate with the bottom plate 21 because the primary pulley 24 is statically fixed central rod 20.

A plurality of auxiliary shafts 25 may pass through the shelf sections 22 respectively and may be rotatable (in the same direction) relative to the bottom plate 21. A plurality of auxiliary pulleys 26 may be statically mated to the auxiliary shafts 25 and rotatable (at a different speed) relative to rotation of the bottom plate 21. Such auxiliary pulleys 26 revolve (orbit) about stationary primary pulley 24 when the bottom plate 21 is rotated about central rod 20.

A flexible belt 27 may be directly engaged with each of the primary and auxiliary pulleys 24, 26, respectively. Thus, as auxiliary pulleys 26 revolve about primary pulley 24, tension in belt 27 causes it to rotate each auxiliary pulley 26 about a respective auxiliary shaft 25. Belt 27 also travels about the stationary primary pulley 24. Such a structural arrangement provides the unexpected and unpredictable advantage of synchronously rotating the shelf sections 22 at a first revolution per minute (first speed), while the bottom plate 21 rotates at a second revolution per minute (second speed) about central rod 20. Rotation of belt 27 about stationary primary pulley 24 is caused by tension in belt 27 with orbital movement of auxiliary pulleys 26 about stationary primary pulley 24. For example, when an external force is exerted against the bottom plate 21 (such as when a user manually rotates the bottom plate 21), the auxiliary pulleys 26 orbit about primary pulley 24. The first speed of the shelf sections 22 about their respective auxiliary shafts 25 relative to the second speed of the bottom plate 21 about central rod 20 is achieved by calibrating the diameters of the auxiliary pulleys 26 to be smaller than the diameter of the primary pulley 24.

Referring now to FIG. 4, as noted above, rotation of the bottom plate 21 causes the auxiliary pulleys 26 to orbit and belt 27 to rotate about the auxiliary pulleys 26. Rotation of auxiliary pulleys 26 is directed along a first rotational path 92 (clockwise) while the bottom plate 21 rotates along a second rotational path 93 (clockwise) and thereby causes the shelf sections 22 to rotate clockwise while the bottom plate 21 also rotates clockwise respectively. Such an arrangement provides the unexpected and unpredictable advantage of providing simultaneous uni-directional movement (clockwise) of shelf sections 22 without individually grabbing and rotating each shelf section 22. In other words, rotation of the bottom plate 21 causes simultaneous rotation of shelf sections 22. One skilled in the art understands the term "clockwise" is relative and can be interchangeable used with "counter clockwise" as long as both the auxiliary pulleys 26 and bottom plate 21 rotate in the same direction; i.e. both clockwise or both counter clockwise.

Referring to FIGS. 1 and 2, as a non-limiting example, each of the shelf sections 22 may include a plurality of planar divider members 28 equidistantly spaced apart and radially extending outward from the auxiliary shafts 25, respectively. A plurality of pie-shaped shelves 29 may be directly abutted with adjacent ones of the divider members 28 respectively such that each pie-shaped shelf is isolated from an adjacent and co-planar one of the pie-shaped shelves 29. Notably, each of the auxiliary shafts 25 may be statically mated to the divider members 28 and the pie-shaped shelves 29, respectively, so that the shelf sections 22 rotate in sync with the auxiliary pulleys 26. Such an arrangement provides the unexpected and unpredictable advantage of synchronously rotating each shelf section 22 upon synchronous rotation of auxiliary pulleys 26.

Referring to FIGS. 1, 2 and 5, as a non-limiting example, the carousel 10 may further include a base member 30 statically mated to a bottom end 31 of the central rod 20 and a top plate 32 rotatably mated to the central rod 20. The top plate 32 is statically connected to the bottom plate 21 via a plurality of anchor rods 75. In this way, top plate 32 simultaneously rotates in sync with the bottom plate 21 Conversely, base member 30 and central rod 20 may remain stationary while the bottom plate 21, top plate 32 and shelf sections 22 rotate in the same direction (i.e., clockwise), respectively. Such an arrangement provides the unexpected and unpredictable advantage of ensuring carousel 10 is statically supported by the base member 30 on a support surface while the top and bottom plates 32, 21 simultaneously rotate in sync with each other.

As a non-limiting example, a protective housing 33 may be removably mated to the base member 30 such that the bottom plate 21 and the shelf sections 22 respectively rotate within an outer perimeter of the protective housing 33. As perhaps best shown in FIGS. 1-3, protective housing 33 may include a plurality of openings 34 defining a line of sight to the bottom plate 21 as well as the shelf sections 22.

The present disclosure may further include a method of utilizing a rotatable display carousel 10 for exhibiting a plurality of products within a confined area. Such a method may include the chronological steps of: providing a stationary central rod 20; providing and rotatably mounting a bottom plate 21 about the central rod 20; providing and rotatably positioning a plurality of shelf sections 22 above the bottom plate 21 respectively; respectively rotating each of the shelf sections 22 by rotating the bottom plate 21 about the central rod 20 such that each shelf section 22 rotates in sync based upon a rotational speed of the bottom plate 21; and maintaining the central rod 20 stationary while the bottom plate 21 and the shelf sections 22 rotate respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A rotatable display carousel for exhibiting a plurality of products within a confined area, said rotatable display carousel comprising:

a central rod;

a bottom plate mounted about said central rod;

a plurality of shelf sections positioned above said bottom plate respectively; and means for rotating each of said shelf sections by rotating said bottom plate about said central rod such that each of said shelf sections rotate in sync based upon a rotational speed of said bottom plate, said means for rotating including a plurality of auxiliary pulleys and a plurality of auxiliary shafts;

wherein each of said shelf sections comprises a plurality of divider members, and a plurality of pie-shaped shelves abutted with adjacent ones of said divider members respectively;

wherein each of said auxiliary shafts are statically mated to said divider members and said pie-shaped shelves so that said shelf sections rotate in sync with said auxiliary pulleys respectively.

2. The display carousel of claim 1, wherein each of said shelf sections are simultaneously rotated about a unique fulcrum axis centrally registered along a corresponding longitudinal length of said shelf sections respectively.

3. The display carousel of claim 1, while said bottom plate rotates about a central fulcrum axis defined along said central rod, wherein each of said shelf sections completes more than one revolution when said bottom plate completes one revolution.

4. The display carousel of claim 1, wherein said central rod is positioned orthogonal to said bottom plate and remains centrally aligned between said shelf sections such that said central rod is equidistantly spaced from said shelf sections respectively.

5. The display carousel of claim 1, wherein said means for rotating comprises:

a primary pulley mated to said central rod and located subjacent to said bottom plate respectively;

said auxiliary shafts passing through said shelf sections respectively, said auxiliary shafts being rotatable relative to said bottom plate and statically mated to said shelf sections respectively; and a belt engaged with each of said primary and auxiliary pulleys respectively.

6. The display carousel of claim 5, wherein rotation of said bottom plate causes said auxiliary pulleys to revolve about said primary pulley, wherein revolution of said auxiliary pulleys causes said belt to rotate about said primary and auxiliary pulleys respectively, wherein said auxiliary pulleys rotate clockwise while said primary pulley remains stationary and thereby causes said shelf sections to rotate clockwise while said bottom plate also rotates clockwise respectively.

7. The display carousel of claim 5, further comprising:

a base member statically mated to a bottom end of said central rod; and a top plate rotatably mated to said central rod;

wherein said top plate rotates in sync with said bottom plate;

wherein said base member, said primary pulley and said central rod remain stationary while said bottom plate, said top plate and said shelf sections rotate in a clockwise direction respectively.

8. A rotatable display carousel for exhibiting a plurality of products within a confined area, said rotatable display carousel comprising:

a stationary central rod;

a bottom plate rotatably mounted about said central rod;

a plurality of shelf sections positioned above said bottom plate respectively; and means for rotating each of said shelf sections respectively by rotating said bottom plate about said central rod such that each of said shelf sections rotate in sync based upon a rotational speed of said bottom plate;

wherein said central rod remains stationary while said bottom plate and said shelf sections rotate in a same rotational direction respectively;

wherein said means for rotating comprises a primary pulley mated to said central rod and located subjacent to said bottom plate respectively, a plurality of auxiliary shafts passing through said shelf sections respectively, said auxiliary shafts being rotatable relative to said bottom plate and statically mated to said shelf sections respectively, a plurality of auxiliary pulleys mated to said auxiliary shafts and rotatable relative to said bottom plate, and a belt engaged with each of said primary and auxiliary pulleys respectively;

wherein each of said shelf sections comprises a plurality of divider members spaced apart and extending outward from said auxiliary shafts respectively, and a plurality of pie-shaped shelves abutted with adjacent ones of said divider members respectively;

wherein each of said auxiliary shafts are statically mated to said divider members and said pie-shaped shelves so that said shelf sections rotate in sync with said auxiliary pulleys respectively.

9. The display carousel of claim 8, wherein each of said shelf sections are simultaneously rotated about a unique fulcrum axis centrally registered along a corresponding longitudinal length of said shelf sections respectively.

10. The display carousel of claim 8, while said bottom plate rotates about a central fulcrum axis defined along said central rod, each of said shelf sections completes more than one revolution when said bottom plate completes one revolution.

11. The display carousel of claim 8, wherein said central rod is positioned orthogonal to said bottom plate and remains centrally aligned between said shelf sections such that said central rod is equidistantly spaced from said shelf sections respectively.

12. The display carousel of claim 8, wherein rotation of said bottom plate causes said auxiliary pulleys to revolve about said primary pulley, wherein revolution of said auxiliary pulleys causes said belt to rotate about said primary and auxiliary pulleys respectively, wherein said auxiliary pulleys rotate clockwise while said primary pulley remains stationary and thereby causes said shelf sections to rotate clockwise while said bottom plate also rotates clockwise respectively.

13. The display carousel of claim 8, further comprising:

a base member statically mated to a bottom end of said central rod; and a top plate rotatably mated to said central rod;

wherein said top plate rotates in sync with said bottom plate;

wherein said base member, said primary pulley and said central rod remain stationary while said bottom plate, said top plate and said shelf sections rotate clockwise respectively.

14. A method of utilizing a rotatable display carousel for exhibiting a plurality of products within a confined area, said method comprising the chronological steps of:

providing a stationary central rod;

providing a bottom plate rotatably mounted about said central rod;

providing a plurality of shelf sections positioned above said bottom plate respectively; and providing a mechanism for rotating each of said shelf sections respectively by rotating said bottom plate about said central rod such that each of said shelf sections rotate in sync based upon a rotational speed of said bottom plate;

said central rod remains stationary while said bottom plate and said shelf sections rotate in a same rotational direction respectively;

said mechanism for rotating comprises a primary pulley mated to said central rod and located subjacent to said bottom plate respectively, a plurality of auxiliary shafts passing through said shelf sections respectively, said auxiliary shafts being rotatable relative to said bottom plate and statically mated to said shelf sections respectively, a plurality of auxiliary pulleys mated to said auxiliary shafts and rotatable relative to said bottom plate, and a belt engaged with each of said primary and auxiliary pulleys respectively;

wherein each of said shelf sections comprises a plurality of divider members spaced apart and extending outward from said auxiliary shafts respectively, and a plurality of pie-shaped shelves abutted with adjacent ones of said divider members respectively;

statically mating each of said auxiliary shafts to said divider members and said pie-shaped shelves so that said shelf sections rotate in sync with said auxiliary pulleys respectively.

* * * * *